US011557846B2

(12) United States Patent
Takagi

(10) Patent No.: US 11,557,846 B2
(45) Date of Patent: Jan. 17, 2023

(54) CONNECTOR TERMINAL AND CONNECTOR

(71) Applicant: HIROSE ELECTRIC CO., LTD., Kanagawa (JP)

(72) Inventor: Yuta Takagi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/412,835

(22) Filed: Aug. 26, 2021

(65) Prior Publication Data

US 2022/0085536 A1 Mar. 17, 2022

(30) Foreign Application Priority Data

Sep. 11, 2020 (JP) ..... JP2020-152581

(51) Int. Cl.

| | |
|---|---|
| ***H01R 13/115*** | (2006.01) |
| ***H01R 13/40*** | (2006.01) |
| ***H01R 12/71*** | (2011.01) |
| ***H01R 12/70*** | (2011.01) |
| ***H01R 12/57*** | (2011.01) |

(52) U.S. Cl.

CPC ..... *H01R 13/115* (2013.01); *H01R 12/57* (2013.01); *H01R 12/707* (2013.01); *H01R 12/716* (2013.01); *H01R 13/40* (2013.01)

(58) Field of Classification Search

CPC .. H01R 13/115; H01R 12/707; H01R 12/716; H01R 13/40; H01R 12/73; H01R 13/405; H01R 43/24; H01R 12/57; H01R 13/2442; H01R 13/02; H01R 12/71; H01R 13/2407; H01R 12/712

See application file for complete search history.

(56) References Cited

U.S. PATENT DOCUMENTS

| | | | | |
|---|---|---|---|---|
| 7,993,146 | B2 * | 8/2011 | Midorikawa | H01R 12/716 439/74 |
| 11,398,697 | B2 * | 7/2022 | Komoto | H01R 43/20 |
| 2010/0151702 | A1 * | 6/2010 | Chen | H01R 12/707 439/65 |
| 2011/0111648 | A1 * | 5/2011 | Takeuchi | H01R 12/716 439/884 |
| 2017/0098900 | A1 | 4/2017 | Kobuchi et al. | |
| 2020/0395704 | A1 * | 12/2020 | Hosoda | H01R 13/405 |
| 2021/0111504 | A1 * | 4/2021 | Kobayashi | H01R 12/91 |

FOREIGN PATENT DOCUMENTS

JP 2017-69133 A 4/2017

* cited by examiner

*Primary Examiner* — Travis S Chambers

(74) *Attorney, Agent, or Firm* — Rankin, Hill & Clark LLP

(57) ABSTRACT

Provided is a connector terminal which includes: a mounting portion having a flat surface in a width direction and a depth direction; a holding target portion formed continuously to the mounting portion, formed in an inverted U-shape in a height direction; a base portion formed continuously to the holding target portion and having a flat surface in the width direction and the depth direction; and an elastic arm portion formed continuously to the base portion, having a standing portion extending in the height direction, and having a length in the width direction, in which a length of the standing portion in the width direction is approximately maximum among lengths of the connector terminal in the width direction.

10 Claims, 13 Drawing Sheets

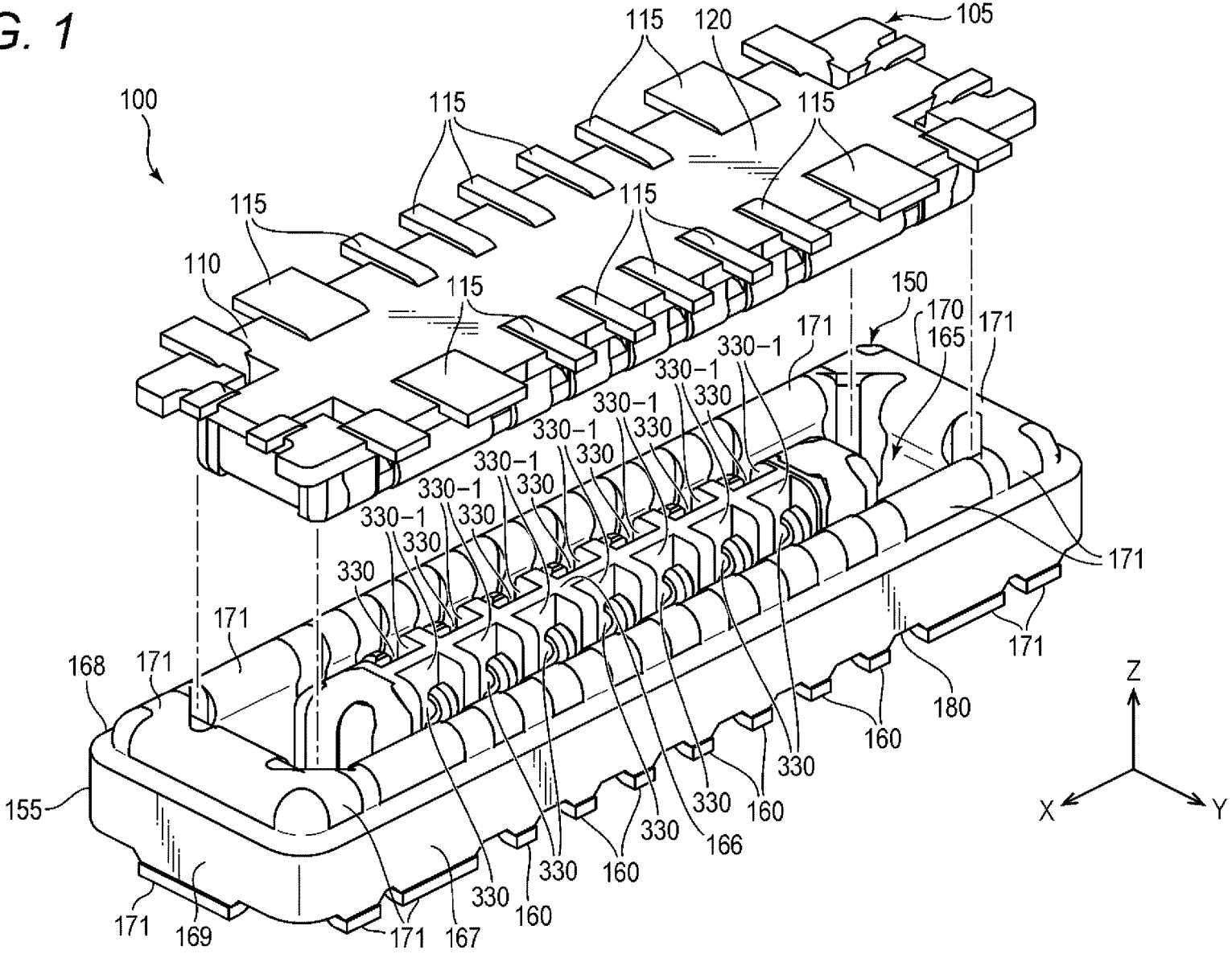
105
120
115
115
115
115
115
115
110
100
150
170
165
171
171
171
171
171
171
171
171
171
330-1
330
330
330

CONNECTOR TERMINAL AND CONNECTOR

CROSS-REFERENCE TO RELATED APPLICATION

This application claims priority from Japanese Patent Application No. 2020-152581 filed with the Japan Patent Office on Sep. 11, 2020, the entire content of which is hereby incorporated by reference.

BACKGROUND

1. Technical Field

The present disclosure relates to a connector terminal and a connector.

2. Related Art

For an electronic device such as a mobile device including a wearable device such as wireless earphones or smart glasses, a laptop computer, a smartphone, and a tablet, size reduction in a component used for the electronic device has been continuously demanded. Further size reduction has been also demanded for a connector as part of the component.

JP-A-2017-069133 discloses a size-reduced connector. FIG. 8 shows an enlarged view of a housing 20 of a connector 10 and terminal housing portions 290 of the housing 20 from above. In FIG. 8, the multiple terminal housing portions 290 arranged in an Y-direction are formed in two lines in an X-direction in the housing 20. The terminal housing portions 290 provided in the housing 20 are covered with three walls including two partition walls 284 having flat surfaces perpendicular to the +Y-direction and the −Y-direction and an intermediate wall (an opposing wall 280) having a flat surface perpendicular to the +X-direction and the −X-direction. FIG. 2 showing the connector from above shows that there is a clearance among a terminal 30 and the two partition walls 284 in each terminal housing portion 290.

SUMMARY

A connector terminal according to an embodiment of the present disclosure is configured to include: a mounting portion having a flat surface at least in a width direction as a first axis direction and a depth direction as a second axis direction; a holding target portion formed continuously to the mounting portion, formed in an inverted U-shape in a height direction as a third axis direction, and having a length in the width direction; a base portion formed continuously to the holding target portion through a base portion transition portion and having a flat surface at least in the width direction and the depth direction; and an elastic arm portion formed continuously to the base portion through a standing transition portion, having a standing portion extending in the height direction and a portion which is to contact a terminal of a partner connector, and having a length in the width direction, in which a length of the standing portion in the width direction is approximately maximum among lengths of the connector terminal in the width direction. Since the length of the standing portion in the width direction is approximately maximum, the length of the entirety of the terminal in the width direction can be reduced while the strength of the terminal can be improved.

BRIEF DESCRIPTION OF THE DRAWINGS

FIG. 1 is a perspective view of a connector assembly including connectors according to an embodiment, a plug being arranged on the upper side and a receptacle being arranged on the lower side in the perspective view;

DETAILED DESCRIPTION

Figure 2A:
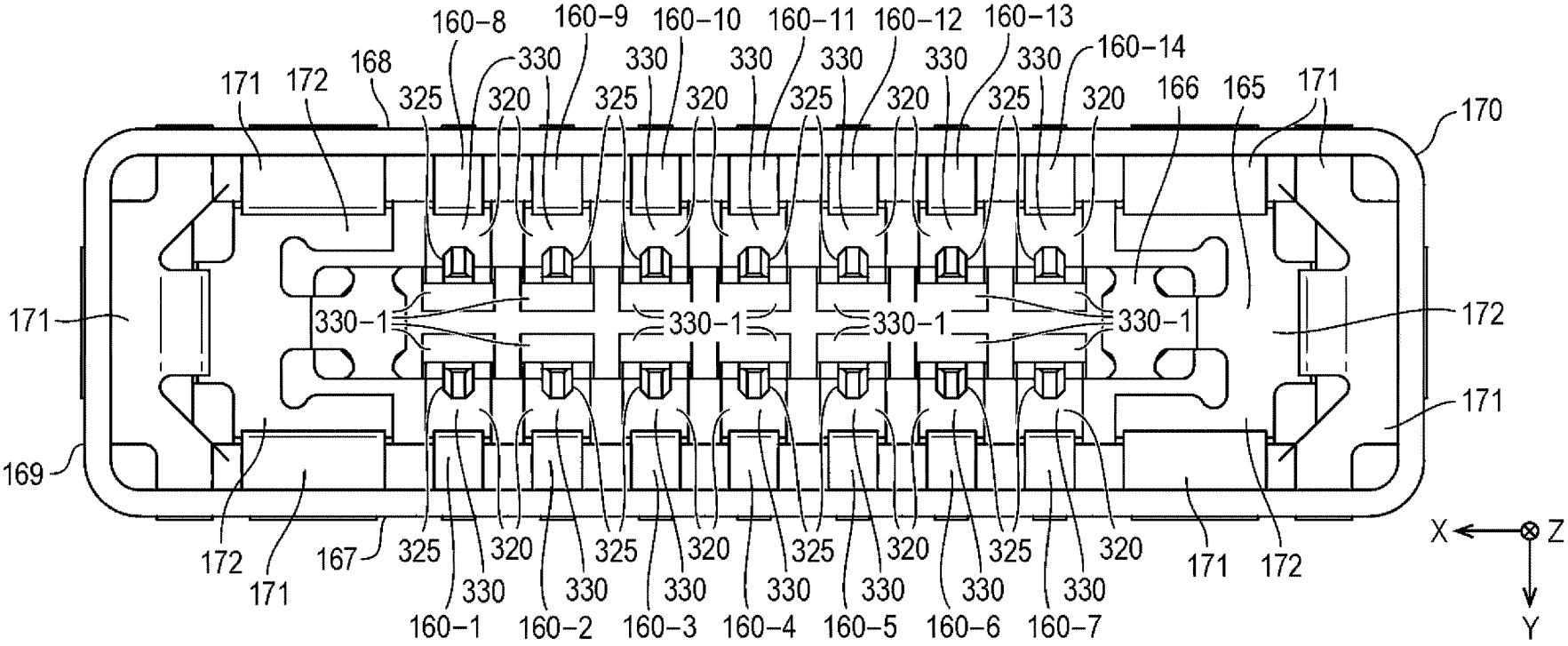
FIG. 2A is an upper view of the receptacle from the side of fitting onto the plug in arrangement of FIG. 1.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the technique of JP-A-2017-069133, the clearance is formed between the connector terminal and the housing, and for this reason, the size of the connector in a predetermined direction (the Y-direction in FIG. 8) is increased. Thus, there is room for reduction in the size of the connector.

For this reason, the present disclosure provides a connector terminal and a connector reduced in size by elimination or narrowing of a clearance between a connector terminal and a housing.

A connector terminal according to an embodiment of the present disclosure includes: a mounting portion having a flat surface at least in a width direction as a first axis direction and a depth direction as a second axis direction; a holding target portion formed continuously to the mounting portion, formed in an inverted U-shape in a height direction as a third axis direction, and having a length in the width direction; a base portion formed continuously to the holding target portion through a base portion transition portion and having a flat surface at least in the width direction and the depth direction; and an elastic arm portion formed continuously to the base portion through a standing transition portion, having a standing portion extending in the height direction and a portion which is to contact a terminal of a partner connector, and having a length in the width direction, in which a length of the standing portion in the width direction is approximately maximum among lengths of the connector terminal in the width direction.

In the connector terminal according to the embodiment of the present disclosure, the length of the standing portion in the width direction is the same as a length of a part of a portion of the connector terminal other than the standing portion in the width direction.

A connector including the connector terminal according to the embodiment of the present disclosure is used.

A connector according to an embodiment of the present disclosure includes: multiple terminals; and a housing holding the multiple terminals in a width direction as a first axis direction, in which each of the multiple terminals includes a mounting portion having a flat surface at least in the width direction and a depth direction as a second axis direction, a holding target portion formed continuously to the mounting portion, formed in an inverted U-shape in a height direction as a third axis direction, and having a length in the width direction, a base portion formed continuously to the holding target portion through a base portion transition portion and having a flat surface at least in the width direction and the depth direction, and an elastic arm portion formed continuously to the base portion through a standing transition portion, having a standing portion extending in the height direction and a portion which is to contact a terminal of a partner connector, and having a length in the width direction. The housing has multiple terminal housing portions housing at least some of the multiple terminals, each of the multiple terminal housing portions has an elastic arm portion housing portion, the elastic arm portion housing portion has a first protruding portion side wall parallel with a plane in the height direction and the depth direction, a second protruding portion side wall facing the first protruding portion side wall, and a protruding portion end wall connected to the first protruding portion side wall and the second protruding portion side wall and provided parallel with a plane in the height direction and the width direction, and before the connector is fitted onto the partner connector, at least part of the elastic arm portion closely contacts, faces, or contacts at least one of the first protruding portion side wall or the second protruding portion side wall.

In the connector according to the embodiment of the present disclosure, after the connector has been fitted onto the partner connector, at least part of the elastic arm portion may not closely contact at least one of the first protruding portion side wall or the second protruding portion side wall during such fitting.

In the connector according to the embodiment of the present disclosure, the housing may have a bottom portion holding portion holding the base portion and the standing transition portion.

In the connector according to the embodiment of the present disclosure, the housing may further include a protruding portion forming the elastic arm portion housing portion and a wall partially holding the holding target portion, and each terminal housing portion and each elastic arm portion housing portion may be arranged between the protruding portion and the wall.

In the connector according to the embodiment of the present disclosure, the length of the standing portion in the width direction is approximately maximum among the lengths of each connector terminal in the width direction.

In description below, a receptacle connector and a plug connector included in a connector assembly will be each referred to as a receptacle and a plug. Moreover, the receptacle connector and/or the plug connector will be referred to as a connector in some cases. FIG. 1 is a perspective view of a connector assembly 100 including connectors according to an embodiment of the present disclosure. FIG. 1 shows the perspective view in which a plug 105 is arranged on the upper side and a receptacle 150 is arranged on the lower side. The connector assembly 100 includes the plug 105 and the receptacle 150. The plug 105 includes a housing 110 and terminals 115. The receptacle 150 includes a housing 155 and terminals 160. A surface (a portion of the terminal 115 at an upper surface 120 of the plug 105) of the terminal 115 of the plug 105 and a surface (a portion of the terminal 160 at a lower surface 180 of the receptacle 150) of the terminal 160 of the receptacle 150 are mounting portions. The mounting portions and a plated circuit (not shown) are connected to each other by, e.g., soldering. Generally, after the terminals and the plated circuit have been connected to each other by, e.g., soldering, the receptacle 150 and the plug 105 as a partner connector are fitted to each other. Note that X, Y, and Z shown in FIG. 1 and the later-described figures each indicate the directions of corresponding axes. As necessary, an X-direction, a Y-direction, and a Z-direction will be also each referred to as an X-axis direction, a Y-axis direction, and a Z-axis direction. As necessary, the X-direction, the Y-direction, and the Z-direction are also each referred to as a width direction, a depth direction, and a height direction. As necessary, "+" indicating the positive direction of each axis or "−" indicating the negative direction of each axis is assigned to X, Y, and Z in some cases.

The size of the receptacle 150 is about 5 mm in the width direction, equal to or less than 2 mm in the depth direction, and equal to or less than 1 mm in the height direction. More preferably, the size of the receptacle 150 is about 4 mm in the width direction, about 1.2 mm in the depth direction, and about 1 to 0.4 mm in the height direction. Note that the size in the width direction varies according to the number of terminals. A distance (a pitch) between ones of the multiple terminals 160 arranged in the width direction of the receptacle 150 is an interval of 0.2 to 0.4 mm and preferably about 0.3 mm.

The housing 155 of the receptacle 150 has a housing portion 165 and a protruding portion 166. When the plug 105 and the receptacle 150 are fitted to each other, the housing portion 165 houses at least part of the housing 110 of the plug 105 and at least some of the terminals 115 of the plug 105, and at least part of the protruding portion 166 is housed in the housing 110 of the plug 105. By fitting, the terminals 115 of the plug 105 are connected to the terminals 160 of the receptacle 150. Note that the terminal 115 of the plug 105 is in a raised shape so that the terminals 115 can be inserted into the terminal 160 of the receptacle 150.

The protruding portion 166 of the receptacle 150 protrudes in the Z-direction (the height direction), and extends in the X-direction (the width direction) to have a thickness in the Y-direction at an intermediate portion of the protruding portion 166 in the Y-direction (the depth direction). The protruding portion 166 has elastic arm portion housing portions 330-1 used for dividing the terminals 160 of the receptacle 150 in the X-direction and the Y-direction. A terminal housing portion 330 houses a later-described elastic arm portion 325 in the elastic arm portion housing portion 330-1, and houses at least a later-described base portion 320 and the later-described elastic arm portion 325 in a portion other than the elastic arm portion housing portion 330-1. The housing 155 of the receptacle 150 does not necessarily have a bottom portion at the terminal housing portions 330, and may pass through to the other side. In this case, a metal fitting for fixing the terminal 160 may be placed in the terminal housing portion 330 through a penetration portion upon integral molding. The protruding portion 166 of the receptacle 150 may be used for fitting onto the plug 105. In this case, the housing 110 of the plug 105 is formed corresponding to the protruding portion 166 of the receptacle 150.

The housing portion 165 is surrounded by a first side wall 167 extending in the X-direction of the housing, a second side wall 168 extending in parallel with the first side wall 167, a first end wall 169 formed continuously to the first side wall 167 and the second side wall 168 in the +X-direction, and a second end wall 170 formed continuously to the first side wall 167 and the second side wall 168 in the −X-direction and extending in parallel with the first end wall 169. In the receptacle 150, inner walls of the first side wall 167, the second side wall 168, the first end wall 169, and the second end wall 170, the protruding portion 166 extending in parallel with these inner walls, and a bottom wall 172 (see FIG. 2A) form a groove shape of the housing portion 165. The shape of the plug 105 can be in a protruding shape corresponding to the groove shape. With the shapes of the plug 105 and the receptacle 150, the plug 105 and the receptacle 150 can be fitted to each other.

The receptacle 150 may have reinforcement metal fittings 171 at end portions in the +X-direction and the −X-direction. With the reinforcement metal fittings 171, the strength of the receptacle 150 can be improved.

Figure 2B:
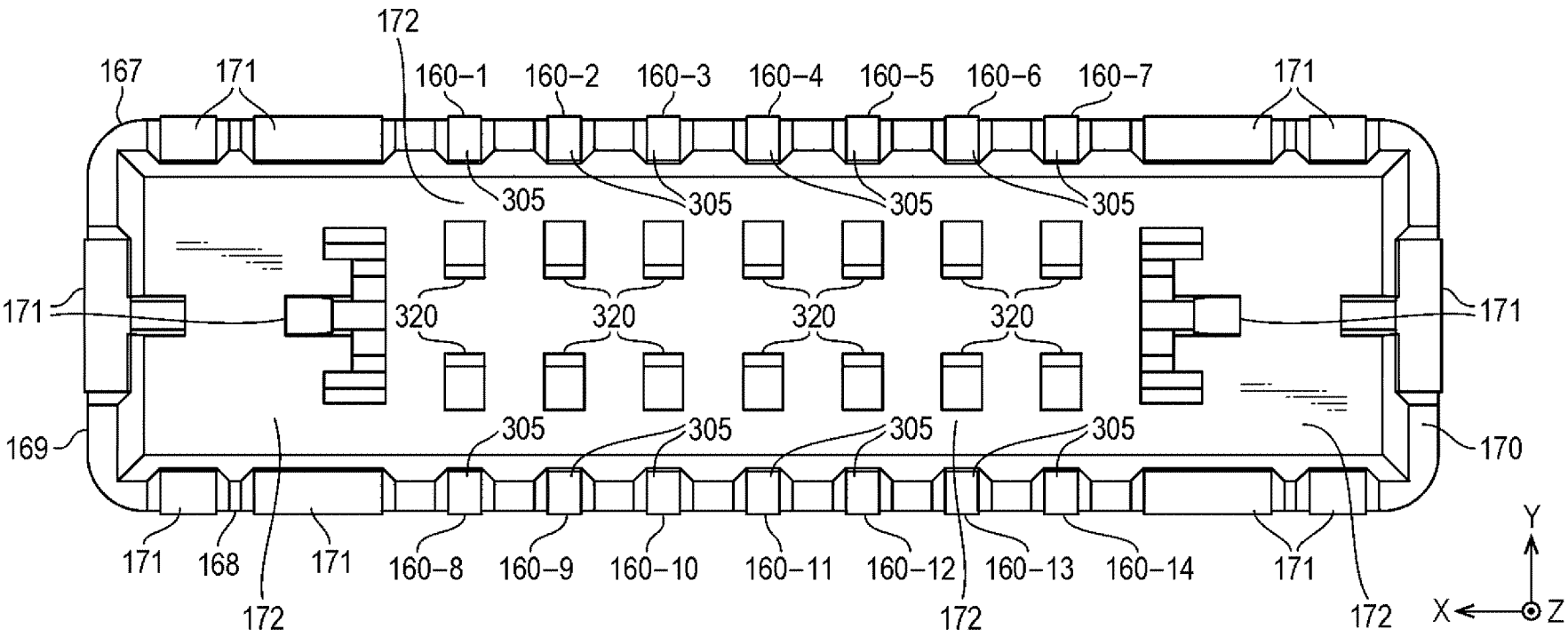
FIG. 2B is a back view of the receptacle from a back side as a side opposite to an upper surface of the receptacle in arrangement of FIG. 1.

FIG. 2A is, in arrangement of FIG. 1, an upper view of the receptacle 150 from a side on which the plug 105 is to be fitted. FIG. 2B is, in arrangement of FIG. 1, a back view of the receptacle 150 from a back surface of the receptacle 150 on the side opposite to an upper surface of the receptacle 150. The receptacle 150 has 14 terminals indicated by terminals 160-*n* and including terminals 160-1 to 160-14.

Figure 3A:
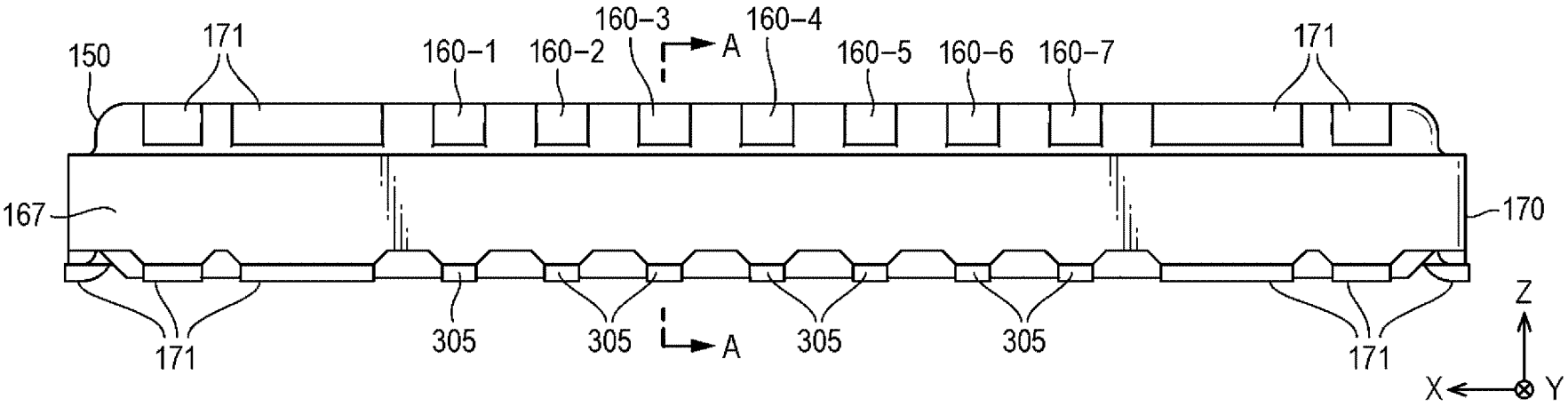
FIG. 3A is a side view of the receptacle when a first side wall is viewed facing a −Y-direction in arrangement of FIG. 1.
Figure 3B:
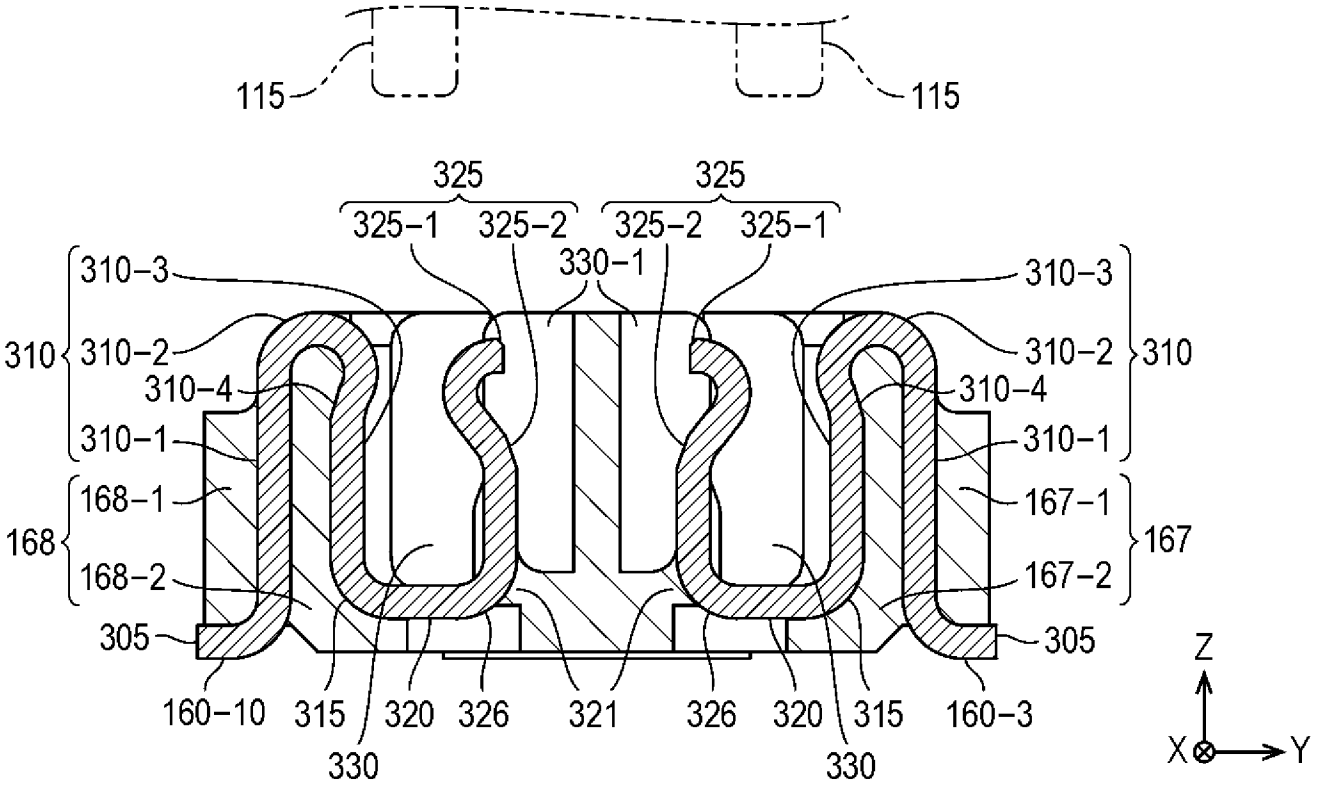
FIG. 3B is a sectional view of the receptacle along a line connecting characters "A" shown in FIG. 3A from the direction of an arrow shown in FIG. 3A.

FIG. 3A is a side view of the receptacle 150 when the first side wall 167 is viewed to face the −Y-direction in arrangement of FIG. 1. It is shown that the terminals 160-1 to 160-7 are arranged at the first side wall 167. FIG. 3B is a sectional view of the receptacle 150 along a line connecting characters "A" shown in FIG. 3A from the direction of an arrow shown in FIG. 3A.

FIG. 3B shows the sections of the terminal 160-3 and the terminal 160-10. The terminals other than the terminals 160-3, 160-10 can also have the same structure as those of the terminals 160-3, 160-10 or structures similar to those of the terminals 160-3, 160-10. As understood from FIGS. 1, 2, and 3, each of the terminals 160 arranged in two lines in the Y-axis direction and each of the terminal housing portions 330 as shown in FIG. 1 may be formed in reflection symmetry with respect to the center line of the housing 155 along the Y-axis. Referring to FIGS. 3A and 3B, the terminal 160 has a mounting portion 305, a holding target portion 310, a base portion transition portion 315, the base portion 320, a standing transition portion 326, and the elastic arm portion 325. Referring to FIG. 2A, the terminal housing portion 330 houses the elastic arm portion 325 in the elastic arm portion housing portion 330-1, and houses at least the base portion 320 (a front surface) and the elastic arm portion 325 in a portion other than the elastic arm portion housing portion 330-1. Referring to FIG. 2B, the base portion 320 (a back surface) is arranged on each of the terminal housing portions 330. Each of the terminals 160 is made of a range of conductive materials. Typically, the terminal 160 can be formed of a single metal plate. For example, the terminal 160 is produced by cutting out and pressing of a metal plate.

The mounting portion 305 is connected to the plated circuit by soldering, for example. The mounting portions 305 of the terminal 160-3 and the terminal 160-10 each extend in the −Y-direction and the +Y-direction from the side of mounting on the plated circuit. That is, the mounting portion 305 has a flat surface at least in the X-direction and the Y-direction, and extends in the inward direction of the receptacle 150 from an open end of the mounting portion 305 to a portion connected to the holding target portion 310. Moreover, the mounting portion 305 is formed continuously to the holding target portion 310.

The holding target portion 310 is in an inverted U-shape curved in a raised shape in the +Z-direction. The holding target portion 310 has, at a portion formed continuously to the mounting portion 305, an outer holding target portion 310-1 extending in the +Z-direction. The holding target portion 310 has a curved holding target portion 310-2 formed continuously from the mounting portion 305 through the outer holding target portion 310-1 and forming a U-shaped bottom portion. The curved holding target portion 310-2 of the terminal 160-3 extends in the −Y-direction. The curved holding target portion 310-2 of the terminal 160-10 extends in the +Y-direction. The curved holding target portion 310-2 is formed continuously to an inner holding target portion 310-3. The inner holding target portion 310-3 extends in the −Z-direction, and is formed continuously to the base portion transition portion 315. With the curve of the curved holding target portion 310-2, the outer holding target portion 310-1 and the inner holding target portion 310-3 face each other substantially in the Z-direction (on the XY plane). The inner holding target portion 310-3 extending in the Z-axis direction changes the extending direction thereof to the Y-axis direction by the base portion transition portion 315. The base portion transition portion 315 is formed continuously to the base portion 320 arranged on the XY plane. The base portion 320 has a flat surface at least in the X-direction and the Y-direction, and is formed continuously to the elastic arm portion 325 through the standing transition portion 326. The elastic arm portion 325 extends in the +Z-direction.

The holding target portion 310 is, by the first side wall 167 or the second side wall 168, held with the holding target portion 310 being embedded in the housing 155. The first side wall 167 has an outer wall 167-1 and an inner wall 167-2. The second side wall 168 has an outer wall 168-1 and an inner wall 168-2. The outer holding target portion 310-1 closely contacts the outer wall 167-1 or the outer wall 168-1 and the inner wall 167-2 or the inner wall 168-2 on the XZ plane, and therefore, is held on the housing 155. The inner holding target portion 310-3 also closely contacts the inner wall 167-2 or the inner wall 168-2 on the XZ plane, and therefore, is held on the housing 155. Part or the entirety of the curved holding target portion 310-2 and the base portion transition portion 315 three-dimensionally closely contacts, due to the curved shapes thereof, the inner wall 167-2 or the inner wall 168-2, and therefore, is held on the housing 155. Thus, the terminal 160 is held on the housing 155 in such a manner that part or the entirety of the holding target portion 310 and the base portion transition portion 315 closely contacts the outer wall 167-1 or the outer wall 168-1 and/or the inner wall 167-2 or the inner wall 168-2.

As shown in FIG. 3B, the inner holding target portion 310-3 of the holding target portion 310 may be formed to extend in the Z-axis direction after having been bent in the outward direction (the +Y-direction or the −Y-direction in the case of the terminal 160-3 and the terminal 160-10) of the housing 155 at a step portion 310-4. With the shape of the holding target portion 310, the Y-axis-direction length of the inner wall 167-2 or the inner wall 168-2 of the housing 155 contacting the curved holding target portion 310-2 is longer than a length in the Y-axis direction between the surface of the outer holding target portion 310-1 contacting the inner wall 167-2 or the inner wall 168-2 and the surface of the inner holding target portion 310-3 contacting the inner wall 167-2 or the inner wall 168-2. This can more suppress the terminal 160 from falling out of the housing 155. In other embodiments, the inner holding target portion 310-3 of the holding target portion 310 may be formed to linearly extend in the Z-axis direction without curving in the Y-axis direction. In other embodiments, the inner holding target portion 310-3 of the holding target portion 310 may be formed to extend in the Z-axis direction after having been curved in the inward direction (the +Y-direction or the −Y-direction in the case of the terminal 160-3 and the terminal 160-10) of the housing 155.

The length of the base portion 320 in the Y-axis direction can correspond to the length of the terminal 115 of the plug 105 in the Y-axis direction. Depending on the form of the receptacle 150, the length of the base portion 320 in the Y-axis direction can be the same as, slightly shorter than, or slightly longer than the length of the terminal 115 of the plug 105 in the Y-axis direction. Due to a relationship between the length of the base portion 320 in the Y-axis direction and the length of the terminal 115 of the plug 105 in the Y-axis direction, a space is ensured in the Z-direction in the terminal housing portions 330, taking the XY plane formed by the base portion 320 as a bottom surface. With this configuration, the terminal 160 of the receptacle 150 can house the terminal 115 of the plug 105. The base portion 320 may or may not contact the terminal 115 of the plug 105. The plug 105 and the receptacle 150 are fitted to each other, and accordingly, at least one of the curved holding target portion 310-2, the base portion 320, or a contact portion 325-1 of the later-described elastic arm portion 325 contacts part of the terminal 115 of the plug 105. Accordingly, the plug 105 and the receptacle 150 are electrically connected to each other.

The elastic arm portion 325 is formed continuously to the base portion 320 through the standing transition portion 326 at which the direction of extension of the terminal 160 transitions from the Y-axis direction to the Z-axis direction. The standing transition portion 326 is a portion where the terminal 160 transitions from the base portion 320 to a standing portion 325-2 of the elastic arm portion 325. The standing portion 325-2 stands to extend from the standing transition portion 326 in the +Z-direction. The standing transition portion 326 contacts a bottom portion holding portion 321 as part of the protruding portion 166 (the bottom portion holding portion 321 is also shown in FIG. 7B). The bottom portion holding portion 321 of the housing 155 holds the base portion 320 at the bottom portion on the XY plane, and further holds the elastic arm portion 325 at the standing transition portion 326 on the XZ plane (also see FIG. 7B). With this configuration, the terminal 160 is, in the vicinity of the elastic arm portion 325, held not only in the Z-axis direction but also in the Y-axis direction. Thus, when the connectors are fitted to each other, displacement of the elastic arm portion 325 not only in the Z-axis direction but also in the Y-axis direction in the vicinity of the base portion 320 is controlled. Thus, elastic force (contact force in the state of fitting onto the plug 105) of the elastic arm portion 325 acting in the Y-axis direction can be more properly controlled. In other embodiments, the bottom portion holding portion 321 may hold only the base portion 320. In this case, the bottom portion holding portion 321 holds, at the bottom portion, the base portion 320 on the XY plane (the Z-axis direction). In other embodiments, the bottom portion holding portion 321 may hold only the standing transition portion 326.

The protruding portion 166 has, on the side opposite to the side on which the later-described contact portion 325-1 contacts the terminal 115 of the plug 105, the elastic arm portion housing portion 330-1 as part of the terminal housing portion 330 including a space. With such a space, the elastic arm portion 325 can be displaced in the Y-axis direction. FIG. 2A also shows that the elastic arm portion housing portion 330-1 has a space toward the center line of the protruding portion 166 in the Y-axis direction such that the elastic arm portion 325 is displaceable in the Y-axis direction. With the shape of the protruding portion 166, the elastic arm portion 325 is fixed in the vicinity of the base portion 320, and is displaceable in the vicinity of an open end (a portion into which the terminal 115 of the plug 105 is to be inserted) of the terminal 160. Thus, when the terminal 115 of the plug 105 is inserted into the terminal 160 and force is applied in the Y-axis direction, the elastic arm portion 325 expands in the inward direction (the direction toward the center line of the protruding portion 166 in the Y-axis direction) of the housing 155, and generates the elastic force for the terminal 115 of the plug 105. With the elastic force, at least one of the elastic arm portion 325 or the holding target portion 310 sandwiches the terminal 115 of the plug 105, and accordingly, electrical connection is made between the terminal 160 of the receptacle 150 and the terminal 115 of the plug 105.

As shown in FIG. 3B, the elastic arm portion 325 may have the contact portion 325-1 formed to protrude in the outward direction (the +Y-direction or the −Y-direction in the case of the terminal 160-3 and the terminal 160-10) of the housing 155. The contact portion 325-1 is a portion which is to contact the terminal (the terminal 115 of the plug 105 in the present embodiment) of the partner connector. The contact portion 325-1 is formed continuously to the standing portion 325-2 extending in the +Z-direction from the standing transition portion 326. That is, the contact portion 325-1 is formed continuously to the standing transition portion 326 through the standing portion 325-2. With the shape of the contact portion 325-1, a length in the Y-axis direction from the contact portion 325-1 to the inner holding target portion 310-3 is shorter than the length of the terminal 115 of the plug 105 in the Y-axis direction, and therefore, the terminal 160 of the receptacle 150 and the terminal 115 of the plug 105 more firmly closely contact each other. In other embodiments, the elastic arm portion 325 does not necessarily protrude in the Y-axis direction.

In a state in which the plug 105 and the receptacle 150 are not fitted to each other, the length of an open end (a portion into which the terminal 115 of the plug 105 is to be inserted) formed by the contact portion 325-1 and the curved holding target portion 310-2 in the Y-axis direction at the height of a protruding portion of the contact portion 325-1 in the Z-axis direction can be the same as or shorter than the length of the terminal 115 of the plug 105 in the Y-axis direction. Due to a relationship between the length of the open end, which is formed by the contact portion 325-1 and the curved holding target portion 310-2, in the Y-axis direction and the length of the terminal 115 of the plug 105 in the Y-axis direction, the terminal 115 of the plug 105 and the terminal 160 of the receptacle 150 can more reliably contact each other.

As shown in FIG. 2B, at least part of the base portion 320 is not covered with the housing 155. The receptacle 150 according to the present disclosure is, by integral molding (insert molding), produced using the conductive material forming the terminal and an insulating member (e.g., resin) forming a body (the housing). In integral molding, high-temperature resin in a liquid form is applied into a die after the terminals 160 or the like have been arranged in the die, and in this manner, the receptacle 150 is formed. Thus, a portion where the die and the terminal 160 contact each other is not covered with the resin forming the body of the receptacle 150. In the present embodiment, the mounting portion 305 for the plated circuit and/or a portion of the bottom surface of the receptacle 150 through which the terminal 160 is exposed (part or the entirety of the base portion 320) are portions contacting the die.

As understood from description above, the elastic arm portion 325 is bent by housing of the terminal 115 of the plug 105. Moreover, fitting of the connector assembly 100 is repeatedly performed. Thus, strength is required for the terminal 160 used for a small electronic device. As understood from the structure of the terminal 160, the strength of the terminal 160 is improved as the length of the terminal 160 in the width direction (the X-axis direction in FIGS. 1 and 3) increases. Thus, a portion of the elastic arm portion 325 to which force is most applied is formed with the longest length in the width direction so that the strength of the terminal 160 can be improved. Moreover, the length of the entirety of the terminal 160 in the width direction is set shorter than, slightly longer than, or the same as the length of the elastic arm portion 325 in the width direction so that the terminal 160 can be reduced in size in the width direction. Further, in a case where the multiple terminals 160 as described above are arranged in the width direction at the connector (the receptacle 150 in the present embodiment), the terminals 160 also contribute to size reduction in the connector itself.

[Connector Terminal]

Figure 4A:
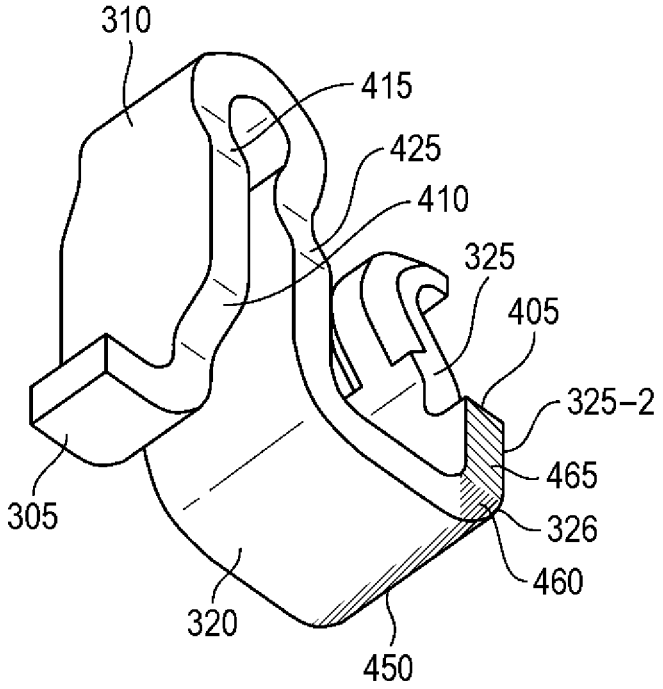
FIG. 4A is a perspective view of a terminal according to the embodiment.
Figure 4B:
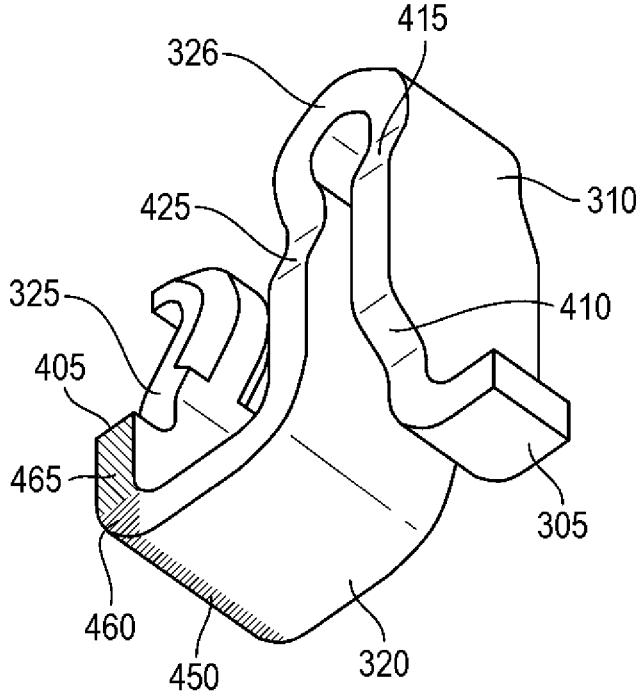
FIG. 4B is a perspective view of the terminal according to the embodiment.
Figure 4C:
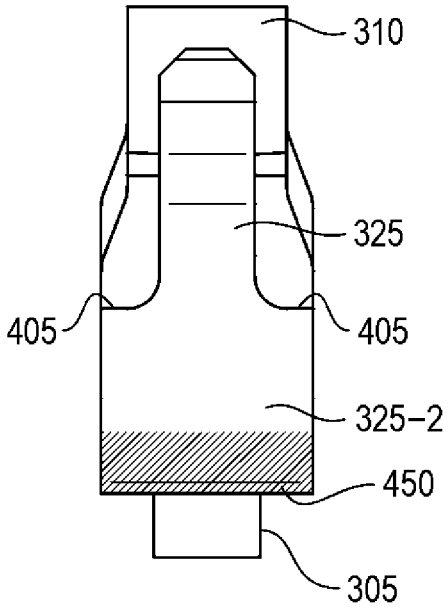
FIG. 4C is a side view of the terminal according to the embodiment.
Figure 4D:
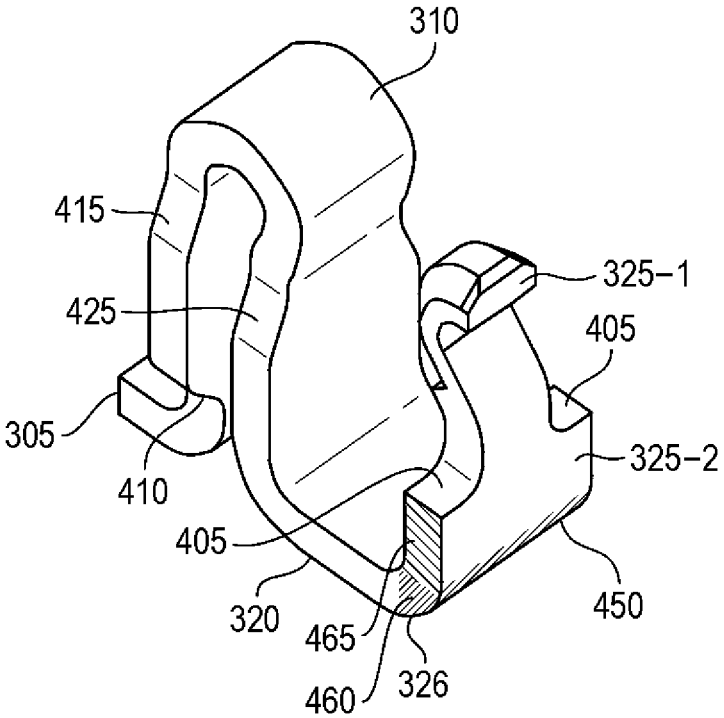
FIG. 4D is a perspective view of the terminal according to the embodiment.
Figure 4E:
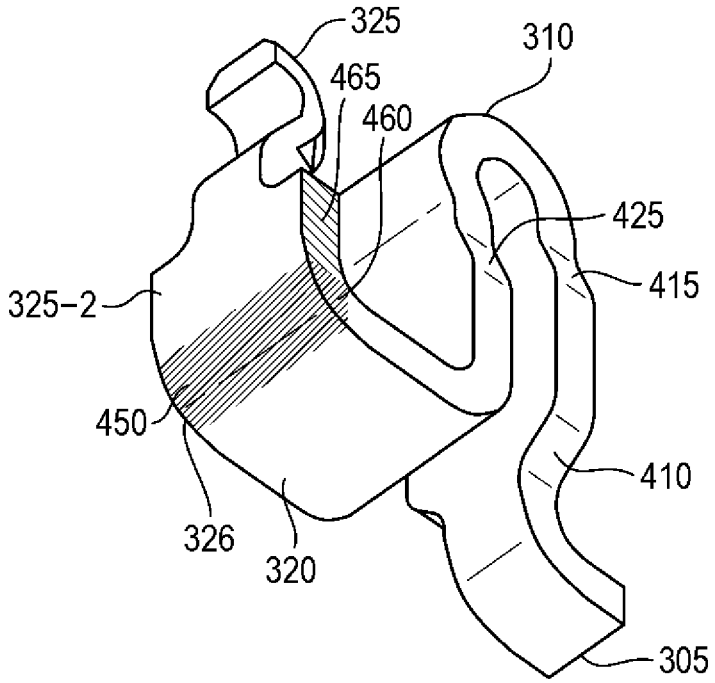
FIG. 4E is a perspective view of the terminal according to the embodiment.

FIGS. 4A to 4G show the terminal 160 from various angles. Of the terminal 160, the elastic arm portion 325 has, from the standing portion 325-2 to the contact portion 325-1, a shoulder portion 405 having a shorter length in the width direction (FIG. 4D). With the shoulder portion 405 of the elastic arm portion 325, the size of the contact portion 325-1 in the width direction can be reduced. With size reduction in the contact portion 325-1, the force generated by the elastic force can be concentrated on a small area of the contact portion 325-1, and the contact portion 325-1 and the terminal 115 of the plug 105 can properly contact each other. As shown in FIGS. 4C and 4D, the shoulder portion 405 may be formed in a form narrowing toward a tip end (or a tapered shape) such that a distance in the width direction is gradually decreased. In other embodiments, the shoulder portion 405 may be formed to have a flat surface perpendicular to the bottom surface of the base portion 320. Not only a continuous portion (410) between the mounting portion 305 and the holding target portion 310 but also a connection portion at which the curved holding target portion 310-2 is formed continuously to the outer holding target portion 310-1 and the inner holding target portion 310-3 may be formed as a shoulder portion 415 and a shoulder portion 425 in shapes similar to that of the shoulder portion 405. In other embodiments, the shoulder portion 405, the shoulder portion 415, and the shoulder portion 425 are not necessarily formed. That is, the length in the width direction can be the same across the entirety of the terminal 160.

As understood from FIGS. 3B, 4C, and 4D, the force is on the standing portion 325-2 of the elastic arm portion 325, and therefore, the length of the terminal in the width direction is longest. Further, it is shown that the length of part or the entirety of other portions (the mounting portion 305, the holding target portion 310, the base portion transition portion 315, the base portion 320, and the standing transition portion 326) of the terminal 160 in the width direction is the same as the length of the standing portion 325-2 in the width direction. Since the length of the standing portion 325-2 in the width direction is maximum, the length of the entirety of the terminal 160 in the width direction can be reduced while the strength of the terminal 160 is improved. In other embodiments, the length of the standing portion 325-2 of the terminal 160 in the width direction may be slightly shorter than the length in the width direction at other portions of the terminal 160. In other embodiments, the length of the standing portion 325-2 of the terminal 160 in the width direction may be maximum among the lengths of the terminal 160 in the width direction. In other words, at the terminal 160, the length of the standing portion 325-2 in the width direction may be the same as or longer than the length of a portion other than the standing portion 325-2 in the width direction. Thus, the length of the standing portion 325-2 in the width direction can be approximately maximum among the lengths of the terminal 160 in the width direction. The phrase "approximately maximum" as described herein means that even if a manufacturing error is ignored, the length of the standing portion 325-2 in the width direction is longer than or the same as the length of a portion other than the standing portion 325-2 in the width direction.

[Connector with Connector Terminals]

Figure 5A:
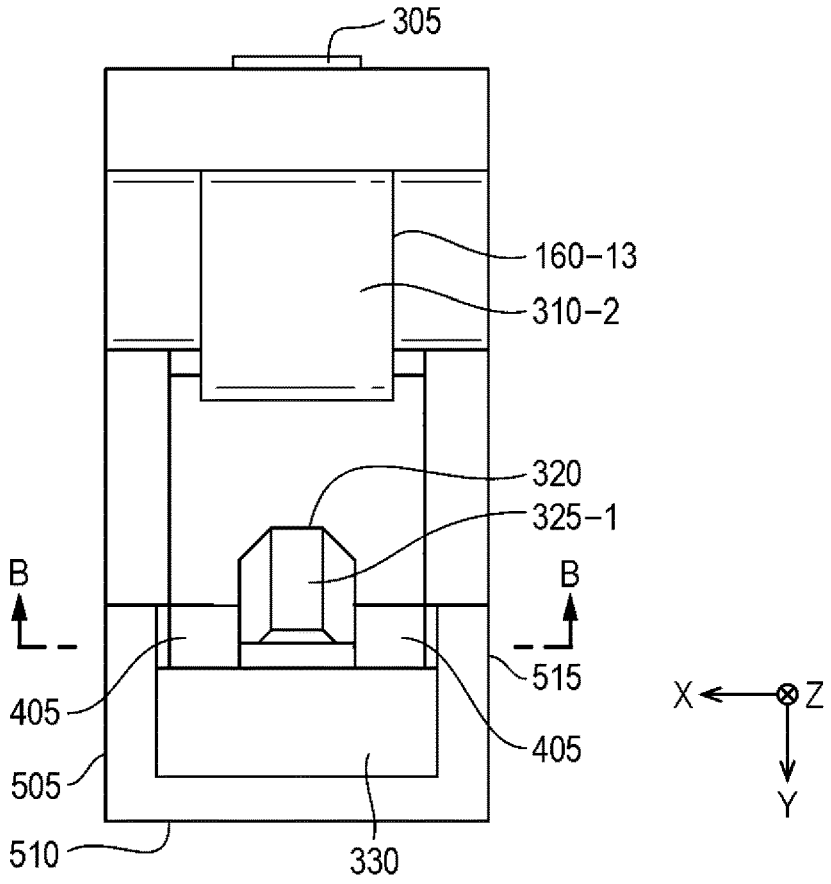
FIG. 5A is an upper view of the terminal of the receptacle in arrangement of FIG. 2A.
Figure 5B:
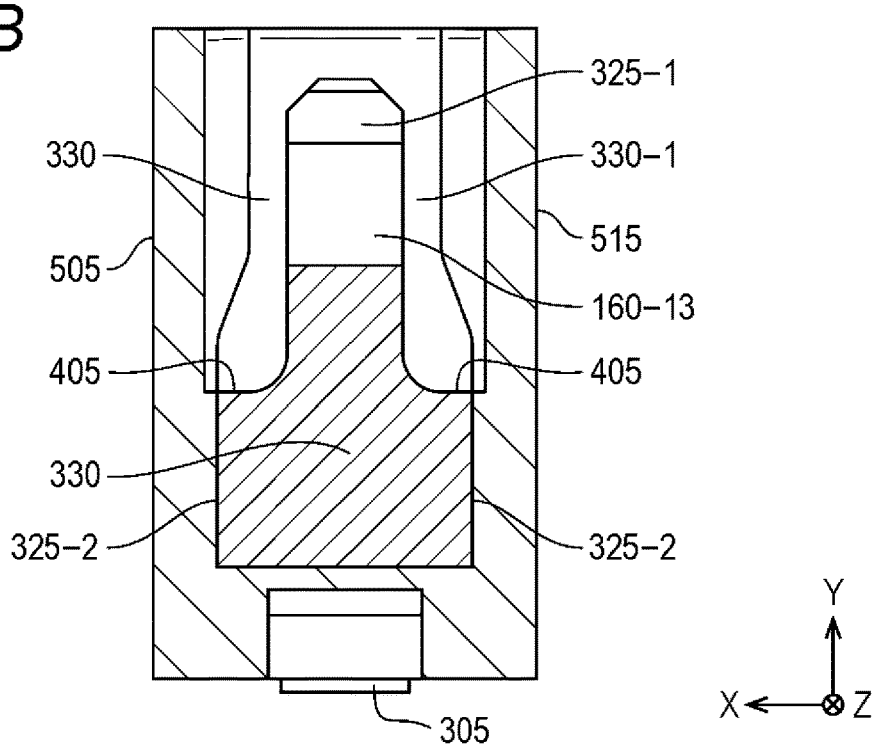
FIG. 5B is a sectional view of the terminal along a line connecting characters "B" shown in FIG. 5A from the direction of an arrow shown in FIG. 5A.

FIG. 5A is an upper view of a portion of the receptacle 150 including the terminal 160-13 in arrangement shown in FIG. 2A. FIG. 5B is a sectional view of the terminal 160-13 along a line connecting characters "B" shown in FIG. 5A from the direction of an arrow shown in FIG. 5A.

As shown in FIGS. 5A, 5B, and 3B, the protruding portion 166 of the housing 155 has the elastic arm portion housing portions 330-1. With the elastic arm portion housing portion 330-1, the elastic arm portion 325 can move mainly in the Y-axis direction. The elastic arm portion housing portion 330-1 is formed by members of the housing 155. The elastic arm portion housing portion 330-1 has a first protruding portion side wall 505, a protruding portion end wall 510, and a second protruding portion side wall 515 as part of the housing 155. The first protruding portion side wall 505 is parallel with a plane in the YZ-direction. The second protruding portion side wall 515 faces the first protruding portion side wall 505, and is parallel with a plane in the YZ-direction. The protruding portion end wall 510 has a surface parallel with a plane in the XZ-direction, and is connected to the first protruding portion side wall 505 and the second protruding portion side wall 515. The elastic arm portion housing portion 330-1 is closed by the first protruding portion side wall 505, the protruding portion end wall 510, and the second protruding portion side wall 515, and on the other hand, the XY plane of the elastic arm portion housing portion 330-1 in the Z-direction and the XZ plane of the elastic arm portion housing portion 330-1 along the Y-axis on a mounting portion 305 side are not closed. Each of the first protruding portion side wall 505, the protruding portion end wall 510, and the second protruding portion side wall 515 reduces short-circuit between such a wall and an adjacent terminal 160. Specifically, regarding the terminal 160-13, the first protruding portion side wall 505, the protruding portion end wall 510, and the second protruding portion side wall 515 reduce short-circuit among these walls and the terminals 160-12, 160-6, 160-14.

As understood from FIG. 5B, the length of the standing portion 325-2 of the terminal 160-13 in the width direction (the X-axis direction) can be the same as or slightly shorter than a length in the width direction between an inner surface (on a terminal 160-13 side) of the first protruding portion side wall 505 and an inner surface (on the terminal 160-13 side) of the second protruding portion side wall 515 in the width direction. Due to a relationship between the length of the standing portion 325-2 in the width direction and the length in the width direction between the first protruding portion side wall 505 and the second protruding portion side wall 515, a space between the terminal 160 and each side wall (the first protruding portion side wall 505 and the second protruding portion side wall 515) can be reduced, and the length of the housing 155 in the width direction can be reduced. The length of the standing portion 325-2 in the width direction can be approximately the same as the length of the base portion 320 in the width direction. The phrase "approximately the same" as described herein means identicalness considering a manufacturing tolerance and the like. In other embodiments, the length of the standing portion 325-2 in the width direction may be slightly shorter or slightly longer than the length of the base portion 320 in the width direction.

In other embodiments, the length of part or the entirety of a portion of the elastic arm portion 325 other than the standing portion 325-2 in the width direction may be the same as the length of the standing portion 325-2 in the width direction. A portion of the standing portion 325-2 on a first protruding portion side wall 505 side and a portion of the standing portion 325-2 on a second protruding portion side wall 515 side may each contact the first protruding portion side wall 505 and the second protruding portion side wall 515. For example, in a case where the resin is applied into the die by integral molding, the standing portion 325-2 may closely contact or contact at least one of the first protruding portion side wall 505 or the second protruding portion side wall 515.

Figure 6A:
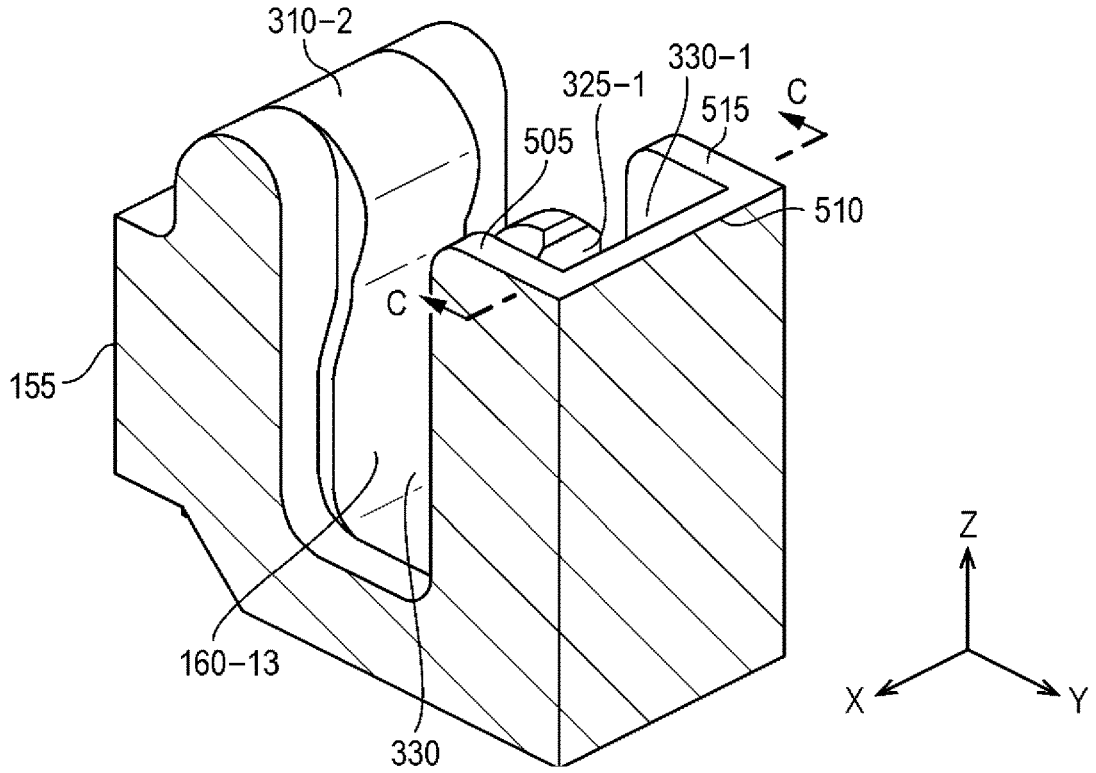
FIG. 6A is a perspective view of the terminal and a housing surrounding the terminal.
Figure 6B:
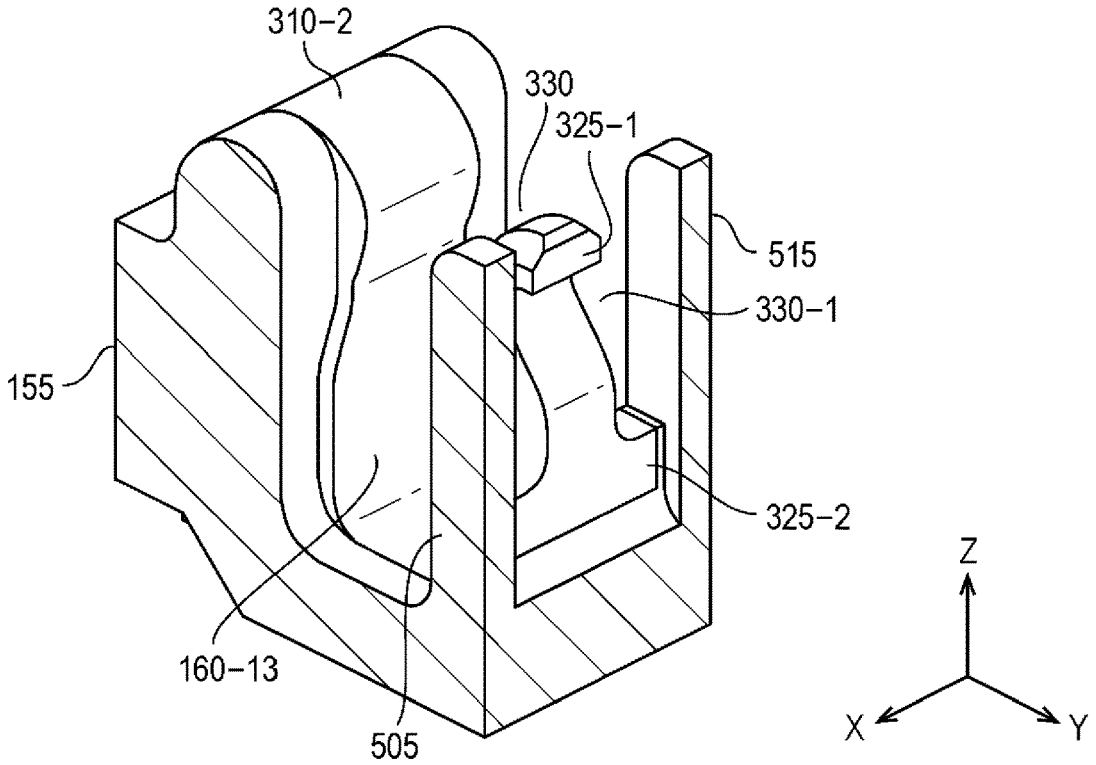
FIG. 6B is a sectional perspective view of the terminal and the housing along a line connecting characters "C" shown in FIG. 6A from the direction of an arrow shown in FIG. 6A.
Figure 6C:
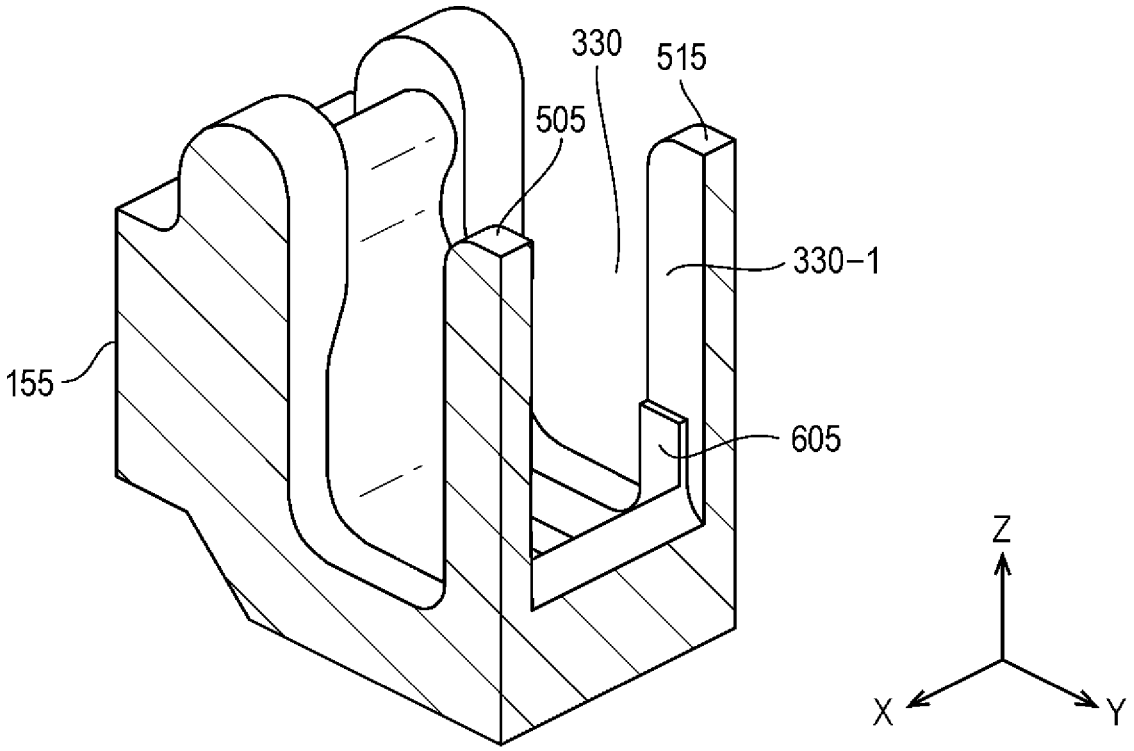
FIG. 6C is a sectional perspective view showing a state in which the terminal is detached from the housing shown in FIG. 6B.

FIG. 6A is a perspective view of the terminal 160-13 and the housing 155 surrounding the terminal 160-13. FIG. 6B is a sectional perspective view of the terminal 160-13 and the housing 155 along a line connecting characters "C" shown in FIG. 6A from the direction of an arrow shown in FIG. 6A. FIG. 6C is a sectional perspective view showing a state in which the terminal 160-13 has been detached from the terminal 160-13 and the housing 155 shown in FIG. 6B. FIG. 6B shows that a portion of the standing portion 325-2 on the second protruding portion side wall 515 side contacts the second protruding portion side wall 515. It is shown that when the resin is applied into the die by integral molding in FIG. 6C, the resin flows into a clearance between the standing portion 325-2 and the second protruding portion side wall 515 (a resin 605 portion, also see FIG. 7B). Due to the resin applied upon integral molding, a portion of the standing portion 325-2 on the second protruding portion side wall 515 side contacts the second protruding portion side wall 515. In the present embodiment, the length of the standing portion 325-2 in the width direction (the X-axis direction) is slightly shorter than the length in the width direction between the inner surface (the terminal side) of the first protruding portion side wall 505 and the inner surface (the terminal side) of the second protruding portion side wall 515, and therefore, the resin flows into the clearance upon integral molding. That is, a portion of the standing portion 325-2 on the second protruding portion side wall 515 side contacts the second protruding portion side wall 515 through the resin 605. In other embodiments, the resin may also flow into the clearance at a portion on the first protruding portion side wall 505 side as in the portion on the second protruding portion side wall 515 side. Alternatively, the resin may flow into the clearance only at the portion on the first protruding portion side wall 505 side. In other embodiments, in a case where the length of the standing portion 325-2 in the width direction (the X-axis direction) is the same as the length in the width direction between the inner surface (the terminal side) of the first protruding portion side wall 505 and the inner surface (the terminal side) of the second protruding portion side wall 515, the inner surface (the terminal side) of the first protruding portion side wall 505 and the inner surface (the terminal side) of the second protruding portion side wall 515 are formed flush with each other.

In a case where the standing portion 325-2 closely contacts the first protruding portion side wall 505 and the second protruding portion side wall 515, if the plug 105 and the receptacle 150 are fitted to each other even once, the standing portion 325-2 may be detached from the first protruding portion side wall 505 and the second protruding portion side wall 515. That is, when the plug 105 is pulled out of the receptacle 150, the standing portion 325-2 no longer closely contacts the first protruding portion side wall 505 and the second protruding portion side wall 515, and can contact the first protruding portion side wall 505 and the second protruding portion side wall 515 or can face the first protruding portion side wall 505 and the second protruding portion side wall 515 without contact. For example, in a state in which the plug 105 is pulled out of the receptacle 150, i.e., a state in which the plug 105 and the receptacle 150 are not fitted to each other, at least part of the standing portion 325-2 no longer closely contacts the first protruding portion side wall 505 and the second protruding portion side wall 515, i.e., contacts or faces the first protruding portion side wall 505 and the second protruding portion side wall 515. Further, while the plug 105 is fitted in the receptacle 150 again after the plug 105 has been pulled out of the receptacle 150, i.e., in a state in which the plug 105 is fitted in the receptacle 150, the standing portion 325-2 no longer closely contacts the first protruding portion side wall 505 and the second protruding portion side wall 515.

Figure 7A:
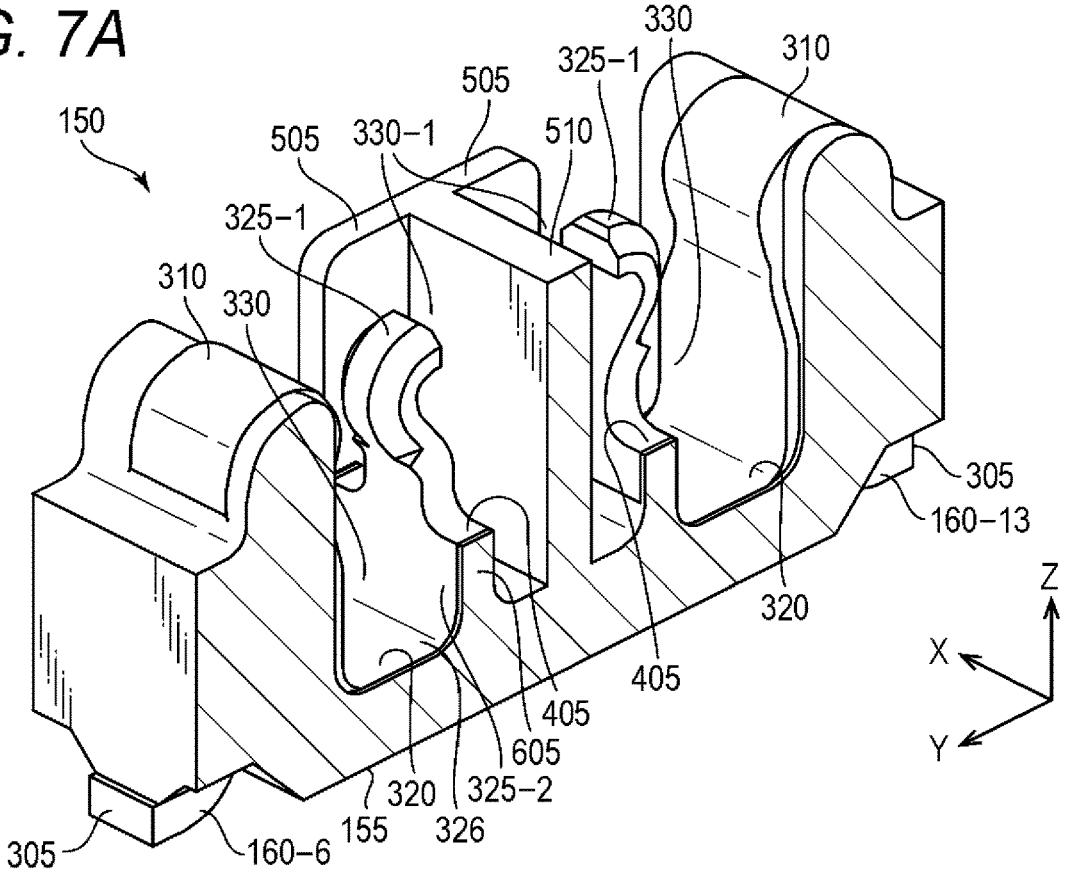
FIG. 7A is a perspective view of the terminals and the housing surrounding the terminals.
Figure 7B:
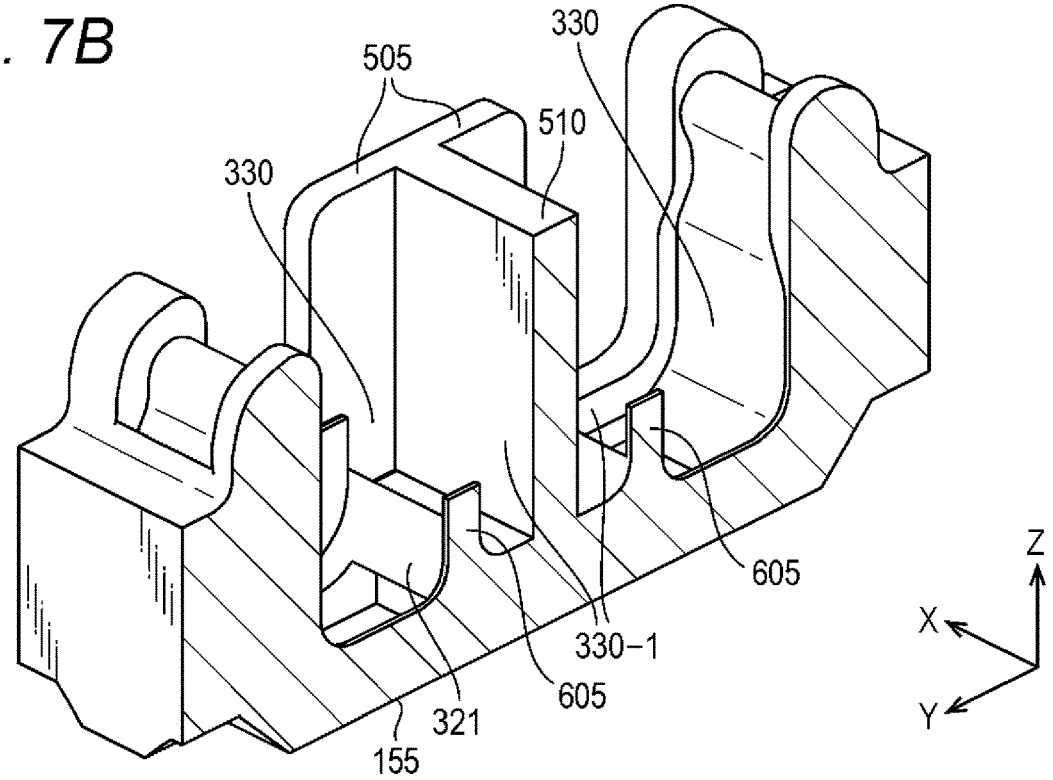
FIG. 7B is a perspective view showing a state in which the terminals are detached from the housing surrounding the terminals as shown in FIG. 7A.

FIG. 7A is a perspective view of part of the connector (the receptacle 150) and a perspective view of the terminal 160-6, the terminal 160-13, and the housing 155 surrounding the terminals 160. FIG. 7B is a perspective view showing a state in which the terminals 160 are detached from the terminals 160 and the housing 155 shown in FIG. 7A. As in FIGS. 6A, 6B, and 6C, FIGS. 7A and 7B show that the standing portion 325-2 closely contacts, contacts, or faces the housing 155. As understood from FIG. 7A, when the terminal 115 of the plug 105 is housed, the contact portion 325-1 of the terminal 160-6 displaces in the −Y-direction. Further, when the plug 105 is detached from the receptacle 150, the contact portion 325-1 of the terminal 160-6 displaces in the +Y-direction. Thus, when the terminal 160 houses the terminal 115 of the plug 105, the contact portion 325-1 displaces in the Y-axis direction. By displacement of the contact portion 325-1 in the Y-axis direction, the standing portion 325-2 also displaces in the Y-axis direction. By displacement of the standing portion 325-2, part of the standing portion 325-2 of the terminal 160-6 no longer closely contacts the first protruding portion side wall 505 and/or the second protruding portion side wall 515 (the resin 605 portion). In other embodiments, only one of the first protruding portion side wall 505 or the second protruding portion side wall 515 may have the resin 605 having flowed to a terminal 160 side from the side wall.

FIG. 7B shows the bottom portion holding portion 321 of the housing 155. As also understood with reference to FIG. 7A, the bottom portion holding portion 321 holds the base portion 320 and/or the standing transition portion 326. When the receptacle 150 houses the plug 105, the bottom portion holding portion 321 holds the base portion 320 to control displacement of the terminal 160 in the Z-axis direction. When the receptacle 150 houses the plug 105, the standing transition portion 326 and the contact portion 325-1 displace in the Y-axis direction. However, at this point, the bottom portion holding portion 321 holds the standing transition portion 326, and in this manner, displacement of part (a portion close to the standing transition portion 326) of the standing portion 325-2 in the Z-axis direction and the Y-axis direction is controlled.

A portion where the standing transition portion 326 and the bottom portion holding portion 321 of the housing 155 closely contact or face each other and a portion where the standing transition portion 326 and the standing portion 325-2 closely contact or face the first protruding portion side wall 505 or the second protruding portion side wall 515 of the housing 155 will be described in more details with reference to FIGS. 4A to 4F.

The standing transition portion 326 is positioned between the base portion 320 and the standing portion 325-2. The portion where the standing transition portion 326 and the bottom portion holding portion 321 closely contact or face each other is a standing transition portion bottom surface 450 hatched in FIGS. 4A to 4F. The portion where the standing transition portion 326 and the first protruding portion side wall 505 or the second protruding portion side wall 515 closely contact or face each other is a hatched standing transition portion side surface 460. The portion where the standing portion 325-2 and the first protruding portion side wall 505 or the second protruding portion side wall 515 closely contact or face each other is a hatched standing portion side surface 465.

Figure 4F:
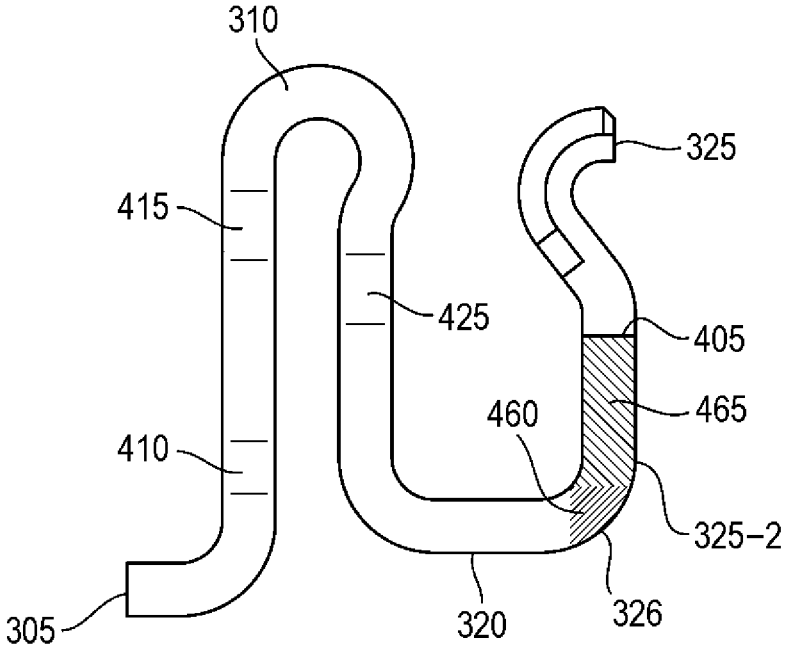
FIG. 4F is a side view of the terminal according to the embodiment.
Figure 4G:
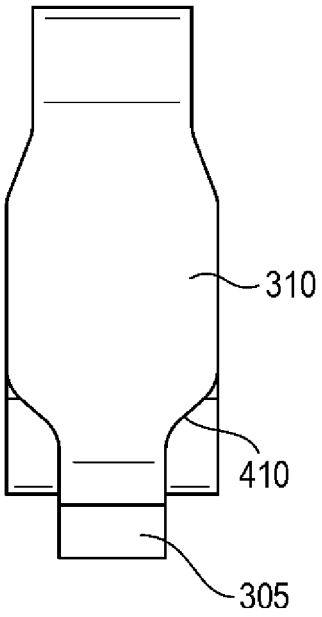
FIG. 4G is a side view of the terminal according to the embodiment.

As understood from FIG. 4F, a boundary between the standing transition portion 326 and the base portion 320 is the YZ plane between the standing transition portion 326 and the base portion 320 in the terminal 160. Specifically, the YZ plane between the standing transition portion 326 and the base portion 320 is the boundary, which is the extension of the YZ plane including an inner wall (a wall on the side on which the plug 105 is housed) of the standing portion 325-2 to the bottom surface of the base portion 320 in the −Z-direction. A boundary between the standing transition portion 326 and the standing portion 325-2 is the XY plane between the standing transition portion 326 and the standing portion 325-2 in the terminal 160. Specifically, the XY plane between the standing transition portion 326 and the standing portion 325-2 in the terminal 160 is the boundary, which is the extension of the XY plane including an inner wall (a wall on the side on which the plug 105 is housed) of the base portion 320 to an outer wall (a wall on the opposite side of the side on which the plug 105 is housed) of the standing portion 325-2 in the Y-axis direction (corresponding to the −Y-direction and the +Y-direction in the case of, e.g., the terminal 160-3 and the terminal 160-10).

The standing transition portion bottom surface 450 is a portion where the standing transition portion 326 and the bottom portion holding portion 321 of the housing 155 closely contact each other. The standing transition portion bottom surface 450 includes the XY plane parallel with the bottom surface of the housing 155, the XZ plane parallel with the first protruding portion side wall 505 and the second protruding portion side wall 515, and a curved surface connecting the XY plane and the XZ plane. Thus, the standing transition portion bottom surface 450 closely contacts the bottom portion holding portion 321. With this configuration, the standing transition portion bottom surface 450 holds the standing transition portion 326 on the bottom portion holding portion 321 in at least one of the Y-axis direction or the Z-axis direction.

The standing transition portion side surface 460 and the standing portion side surface 465 are portions closely contacting or facing the first protruding portion side wall 505 or the second protruding portion side wall 515 of the housing 155. In other embodiments, in a case where there is a clearance between the first protruding portion side wall 505 or the second protruding portion side wall 515 and at least one of the standing transition portion side surface 460 or the standing portion side surface 465, the resin as the material of the housing 155 may flow into the clearance (e.g., FIG. 7B shows the flowed resin 605).

In other embodiments, the bottom portion holding portion 321 may hold only one of the base portion 320 or the standing transition portion 326. In other embodiments, the bottom portion holding portion 321 may not only closely contact or face the standing transition portion 326, but also may hold part of an outer wall surface of the standing portion 325-2. With this configuration, the standing portion 325-2 is more firmly held on the bottom portion holding portion 321 in the Y-axis direction.

The connector assembly 100 described in the above-described embodiment has, as shown in FIG. 1, two lines of terminal arrays that the terminals 115 and the terminals 160 at the bottom surfaces of the plug 105 and the receptacle 150 are arranged as a group in a longitudinal direction. However, such a configuration is an example, and the terminal arrays of the connector assembly 100 may be one line or three or more lines.

Suppose that some terminals of the terminal array arranged in a line are terminals of a first group or all terminals of the terminal arrays arranged in a predetermined number of lines are the terminals of the first group. In this case, the terminals of the first group may be arranged to face a predetermined direction on the bottom surfaces of the plug 105 and the receptacle 150, and terminals of groups other than the terminals of the first group may be arranged to face a direction other than the predetermined direction.

A "first axis," a "second axis," and a "third axis" described in the claims are each equivalent to the "X-direction," the "Y-direction," and the "Z-direction" described in the specification. Moreover, a "first axis direction," a "second axis direction," and a "third axis direction" described in the claims are each equivalent to the "width direction," the "depth direction," and the "height direction" described in the specification, for example.

In the above-described embodiment, the plug 105 and the receptacle 150 are formed using the insulating member and the conductive member forming the terminal by integral molding, but may be formed by other methods such as press-fitting.

In the above-described embodiment, the plug 105 and the receptacle 150 are formed using at least the insulating member and the conductive member forming the terminal by integral molding. However, as can be understood by those skilled in the art, the plug 105 and the receptacle 150 may be, including other members, formed by integral molding.

In the above-described embodiment, the bottom surfaces of the plug 105 and the receptacle 150 have been described as a substantially-rectangular shape, but such a shape is an example. These bottom surfaces may be in other shapes such as a substantially square shape or a substantially triangular shape. The connector assembly 100 including the plug 105 and the receptacle 150 is formed in a shape suitable for an electronic device using the connector assembly 100.

In the above-described embodiment, the receptacle 150 includes the terminals 160, but as can be understood by those skilled in the art, the connector assembly 100 may be configured such that the plug 105 includes the terminals 160.

Regarding each embodiment described above, some or all of the embodiments may be combined and implemented as one embodiment.

The structures and arrangement of the elements of each embodiment described above are merely an example. Those skilled in the art can make many modifications to each embodiment. Examples of such modifications include changes in the sizes, dimensions, structures, shapes, and ratios of various elements, parameter values, attachment arrays, materials to be used, colors, and orientations.

Each embodiment described above is an example for describing the present disclosure, and the present disclosure is not limited to these embodiments. The present disclosure can be implemented in various forms without departing from the gist of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector terminal comprising:

a mounting portion having a flat surface at least in a width direction as a first axis direction and a depth direction as a second axis direction;

a holding target portion formed continuously to the mounting portion, formed in an inverted U-shape in a height direction as a third axis direction, and having a length in the width direction;

a base portion formed continuously to the holding target portion through a base portion transition portion and having a flat surface at least in the width direction and the depth direction; and an elastic arm portion formed continuously to the base portion through a standing transition portion, having a standing portion extending in the height direction and a portion which is to contact a terminal of a partner connector, and having a length in the width direction, wherein a length of the standing portion in the width direction is approximately maximum among lengths of the connector terminal in the width direction.

2. The connector terminal according to claim 1, wherein the length of the standing portion in the width direction is the same as a length of a part of a portion of the connector terminal other than the standing portion in the width direction.

3. A connector comprising:

the connector terminal according to claim 1.

4. The connector according to claim 1, wherein the length of the standing portion in the width direction is longer than lengths of other portions of the connector terminal in the width direction.

5. The connector according to claim 1, wherein the elastic arm portion having a shoulder portion having a shorter length in the width direction, the shoulder portion is formed in a form narrowing toward a tip end such that a distance in the width direction is gradually decreased, and the shoulder portion has a flat surface perpendicular to a bottom surface of the base portion.

6. A connector comprising:

multiple terminals; and a housing holding the multiple terminals in a width direction as a first axis direction, wherein each of the multiple terminals includes a mounting portion having a flat surface at least in the width direction and a depth direction as a second axis direction, a holding target portion formed continuously to the mounting portion, formed in an inverted U-shape in a height direction as a third axis direction, and having a length in the width direction, a base portion formed continuously to the holding target portion through a base portion transition portion and having a flat surface at least in the width direction and the depth direction, and an elastic arm portion formed continuously to the base portion through a standing transition portion, having a standing portion extending in the height direction and a portion which is to contact a terminal of a partner connector, and having a length in the width direction, wherein the housing has multiple terminal housing portions housing at least some of the multiple terminals, each of the multiple terminal housing portions has an elastic arm portion housing portion, the elastic arm portion housing portion has a first protruding portion side wall parallel with a plane in the height direction and the depth direction, a second protruding portion side wall facing the first protruding portion side wall, and a protruding portion end wall connected to the first protruding portion side wall and the second protruding portion side wall and provided parallel with a plane in the height direction and the width direction, and before the connector is fitted onto the partner connector, at least part of the elastic arm portion directly contacts at least one of the first protruding portion side wall or the second protruding portion side wall.

7. The connector according to claim 6, wherein in a state in which the connector is fitted onto the partner connector, at least part of the elastic arm portion does not closely contact at least one of the first protruding portion side wall or the second protruding portion side wall.

8. The connector according to claim 6, wherein in a state in which the partner connector is pulled out of the connector after the connecter has been fitted onto the partner connector, at least part of the elastic arm portion faces or contacts at least one of the first protruding portion side wall or the second protruding portion side wall.

9. The connector according to claim 6, wherein the housing further includes a protruding portion forming the elastic arm portion housing portion, and a wall partially holding the holding target portion, each terminal housing portion and each elastic arm portion housing portion are arranged between the protruding portion and the wall, and each terminal housing portion has a bottom portion holding portion holding at least one of the base portion or the standing transition portion.

10. The connector according to claim 6, wherein a length of the standing portion in the width direction is approximately maximum among lengths of each connector terminal in the width direction.

* * * * *